United States Patent [19]

Widmer

[11] 4,021,993

[45] May 10, 1977

[54] APPARATUS FOR APPLYING A WRAPPER

[76] Inventor: René Widmer, Grossmannstr. 31, 8049 Zurich, Switzerland

[22] Filed: May 1, 1975

[21] Appl. No.: 573,526

[30] Foreign Application Priority Data

May 7, 1974 Switzerland ..... 6168/74

[52] U.S. Cl. ..... 53/120; 53/234

[51] Int. Cl.[2] ..... B65B 63/04

[58] Field of Search ..... 53/21 FW, 32, 33, 120, 53/215, 234, 117, 211; 270/83, 84; 198/241

[56] References Cited

UNITED STATES PATENTS

| | | | |
|---|---|---|---|
| 868,258 | 10/1907 | Farnham | 53/120 |
| 870,501 | 11/1907 | Farnham | 53/120 |
| 979,439 | 12/1910 | Cox | 53/120 |
| 1,108,027 | 8/1914 | Thorschmidt | 53/215 |
| 2,853,839 | 9/1958 | Herrmann | 53/234 X |
| 3,053,024 | 9/1962 | Wexler | 53/120 |
| 3,125,842 | 3/1964 | Ferguson | 53/387 |
| 3,253,379 | 5/1966 | Foradora | 53/24 |

*Primary Examiner*—Travis S. McGehee
*Assistant Examiner*—John Sipos
*Attorney, Agent, or Firm*—W. G. Fasse; W. W. Roberts

[57] ABSTRACT

A wrapper, especially a mailing wrapper is secured to printed matter, such as a newspaper, by folding the paper with a wrapper strip loosely resting on the outside of the paper. After the folding, one end of the wrapper strip extends from the folded paper so that after tilting the paper and the extending wrapper strip the latter is wrapped around the paper. The wrapper strip is long enough to have a protruding end even after the folding and wrapping. The protruding end is then bent over the other wrapper strip end to overlap the latter whereupon the two ends are secured to each other, for example by gluing. In the present apparatus, a paper is advanced in a first direction into a position above a slot. A wrapper strip is advanced in a second direction extending at a right angle to said first direction to a position below said slot. A folding member moves then through the slot to simultaneously fold the paper and the wrapper into a gap of a rotatable and feed advancing device which then makes a partial turn to bend over a protruding wrapper strip end which is then secured to the opposite wrapper end, for example by a pressure roller.

9 Claims, 4 Drawing Figures

Fig. 1
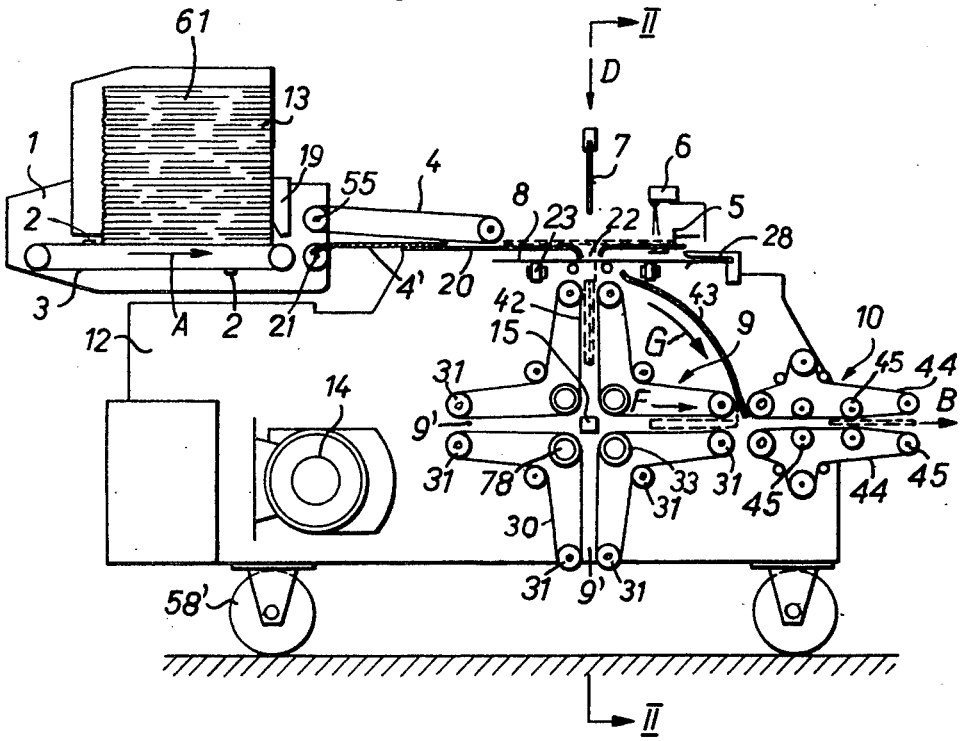
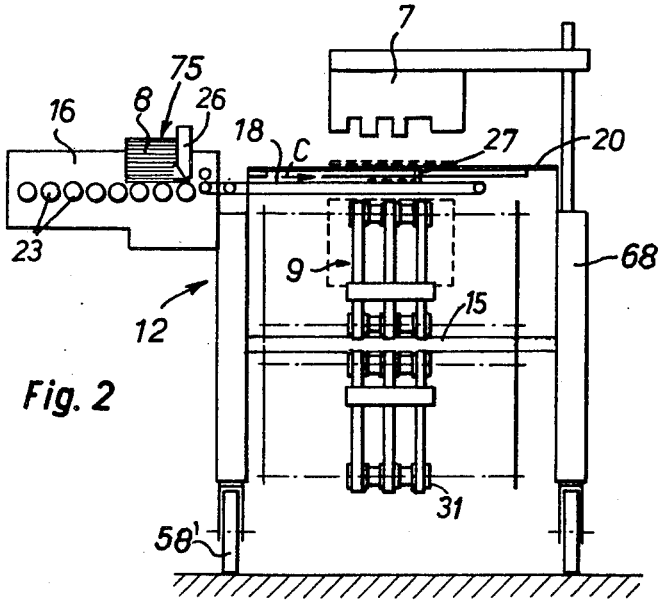
Fig. 2

APPARATUS FOR APPLYING A WRAPPER

BACKGROUND OF THE INVENTION

The present invention relates to a method and apparatus for applying a wrapper, especially to printed matter, for example newspapers, magazines or the like. Such wrappers are also known as news or postal wrappers and usually bear the address of the recipient where the particular printed matter is to be transmitted through the postal services.

OBJECTS OF THE INVENTION

The method of the invention as well as the apparatus according to the invention are directed to solving the problem of efficiently securing so called postal or news wrappers to printed matter, such as newspapers or magazines, in an economic manner whereby simultaneously the ends of the wrapper are to be secured to each other, for example by gluing.

It is another object of the invention to provide a method and apparatus for the wrapping of printed matter whereby wide variations in the thickness of such printed matter shall be taken into account.

SUMMARY OF THE INVENTION

According to the invention there is provided a method for the wrapping of printed matter with a so called postal mailing wrapper which comprises the steps of placing a wrapper, such as a wrapper strip, in a position facing an outer surface of the printed matter whereby one end of the wrapper extends or protrudes from an edge of the printed matter. Thereafter, the printed matter and the wrapper are folded simultaneously along a line substantially in parallel to said edge. After the folding, the printed matter and the wrapper strip are clamped together and tilted in such a direction that said protruding end is bend over said edge of the printed matter in a looping direction so that the protruding wrapper strip end is folded over the other wrapper strip end to provide an overlap between the wrapper ends. Thereafter, the two ends are secured to each other, for example by gluing, whereby a heat sensitive glue may either be applied to the strip or the strip may be provided with such a glue layer before its use.

The apparatus according to the invention is characterized in that folding means are provided which fold the printed matter and the wrapper simultaneously in such a manner that the wrapper is located on the outside of the printed matter. The folding means cooperate with receiving and clamping means as well as with folding over and pressing means for the protruding wrapper end. All these elements are arranged in a common frame structure to form a folding station and a discharge station whereby the receiving and clamping means are arranged intermediate the folding and discharge stations, preferably in the form of a intermittently rotating drum which receives the folded wrapper and printed matter from the folding station to advance it to the discharge station whereby simultaneously the folding over in the looping direction of the protruding wrapper end is accomplished.

It is an advantage of the invention that the combination of relatively simple and economical means permit a high hourly throughput in which the mailing wrappers are automatically applied to the printed matter in an economical manner and at high speeds.

BRIEF FIGURE DESCRIPTION

In order that the invention may be clearly understood, it will now be described, by way of example, with reference to the accompanying drawings, wherein:

FIG. 1 is a schematic side view of an apparatus according to the invention;

FIG. 2 is a vertical section through the apparatus according to FIG. 1 along the section line II—II in FIG. 1;

DETAILED DESCRIPTION OF PREFERRED EMBODIMENTS

Figure 3:
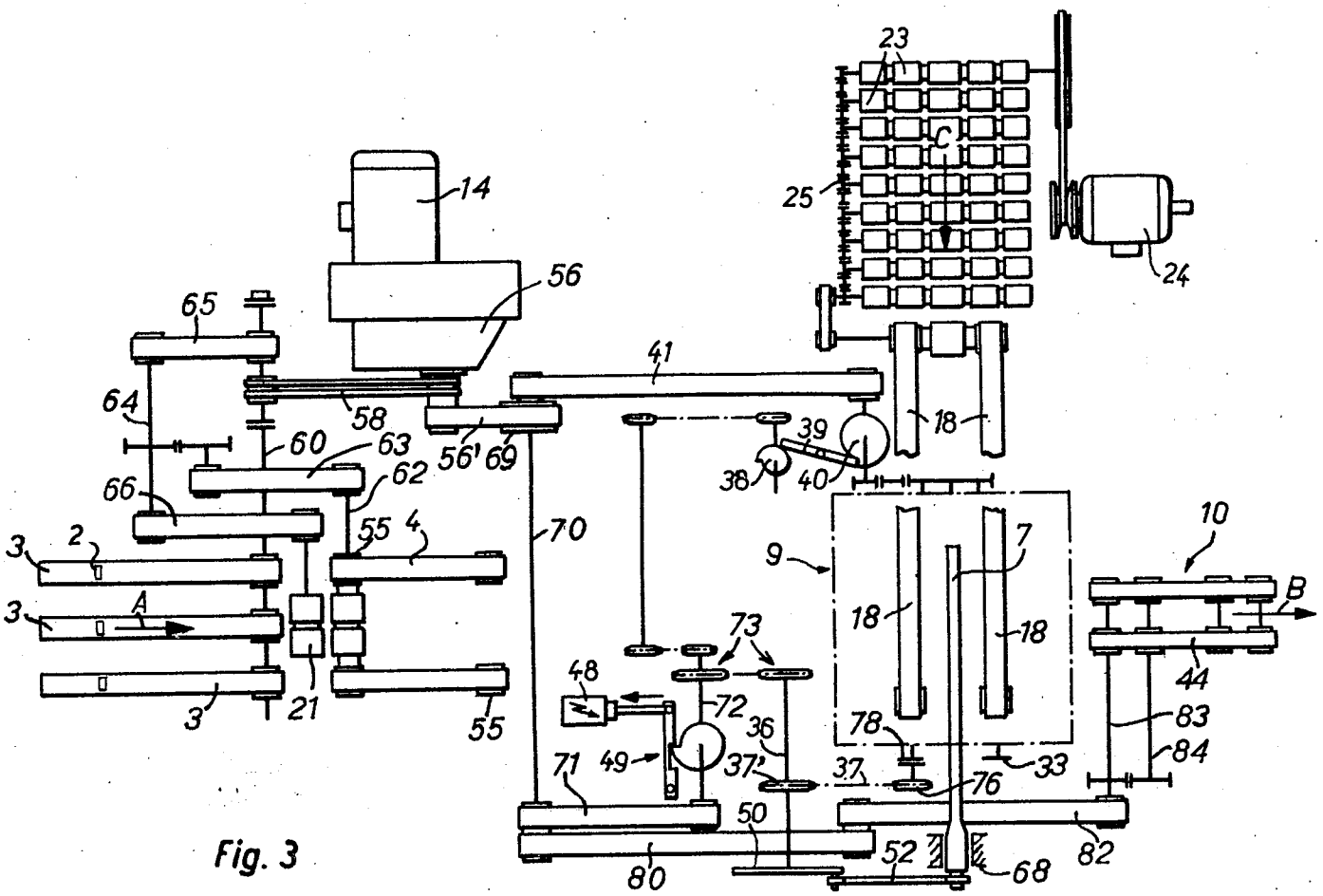
FIG. 3 is a schematic top view of the apparatus according to FIG. 1.
Figure 4:
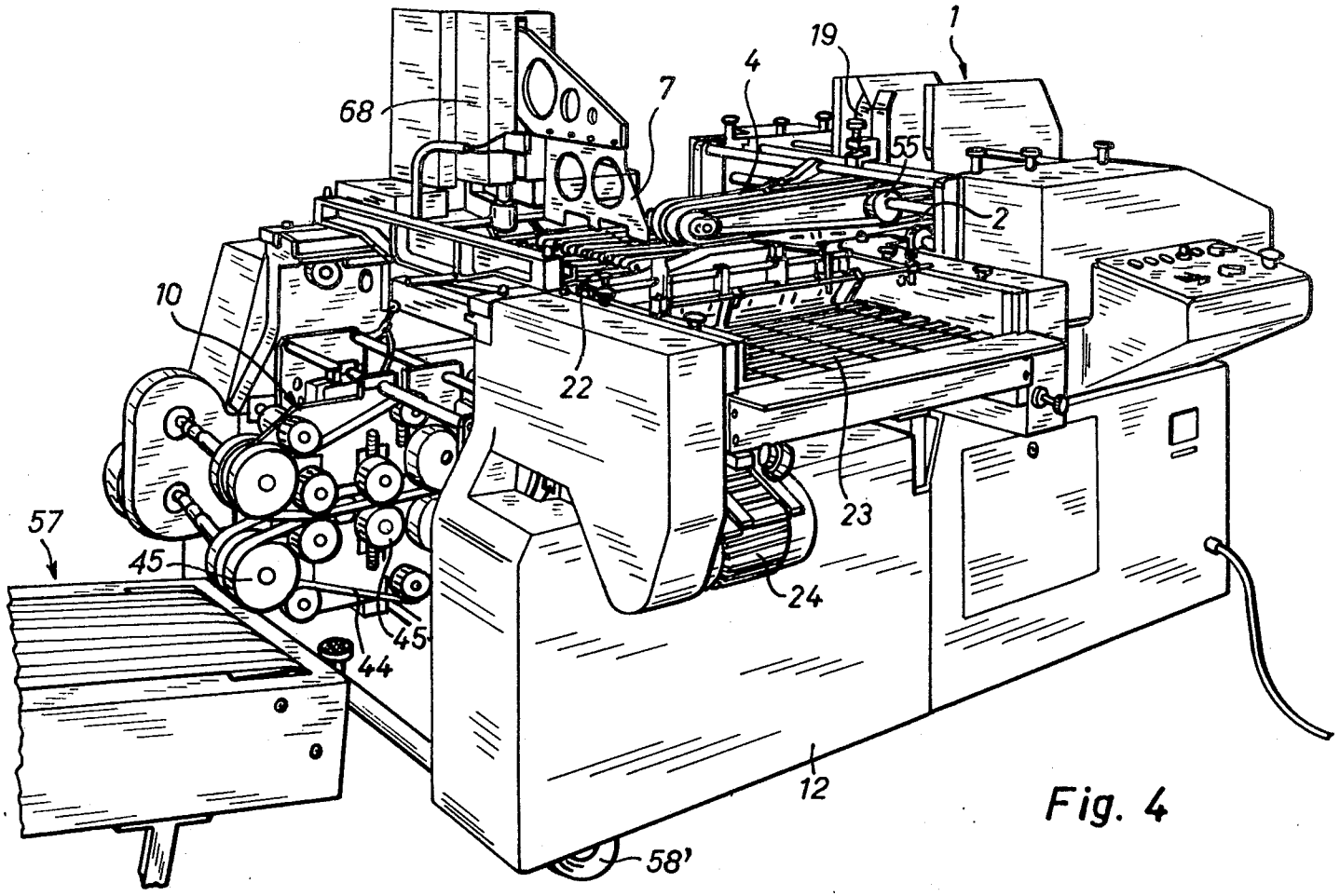
FIG. 4 illustrates a perspective view of the present apparatus.

The apparatus according to the invention is intended for once folding printed matter, such as newpapers, magazines or the like and to simultaneously apply a strip type wrapper of paper or similar material to the printed matter whereupon the strip in its wrapping position is to be glued together, so that the wrapper ends will be secured to each other. The strip wrapper may be provided with an address either prior to the wrapping operation or thereafter.

The individual printed matter items 13, for example newspapers, or magazines, form a stack 61 from which they are removed for providing each item 13 with a wrapper. The stack 61 is supported by a stacking table 1 which in turn is supported by a frame structure 12. The stacking table 1 comprises a plurality of endless conveyor belts 3 on which the stack 61 is supported. The endless conveyor belts 3 are arranged in parallel to each other and spaced from each other. The endless conveyor belts are provided with drive dogs 2 and the upper run of these conveyors belts 3 moves in the direction of the arrow A whereby the drive dogs 2 push a printed item 13 in a one at a time fashion onto further conveyor means to be described in more detail below. Thus, each time the lowest printed item 13 is advanced in the direction of the arrow A, the conveyor belts 3 are driven by the motor 14 through a V-belt 58 running over pulleys on a shaft 60.

A cross bar 19 is arranged on the table 1 to face the right hand edge of the stack 61. The vertical position of the cross bar 19 is adjustable to control the vertical spacing between the lower edge of the cross bar 19 and the plane defined by the upper run of the conveyor belts 3. Thus, a gap is formed having an adjustable width or height corresponding substantially to the thickness of one printed item 13. The gap width will be slightly larger than the thickness of a printed item 13 to permit the easy passage of one item at a time through the gap between the cross bar 19 and the top surface of the conveyor belts 3. The means for adjusting the vertical position of the cross bar 19 in accordance with the thickness of the particular printed item 13 are not shown but well known.

Downstream of the stacking table 1, as viewed in the direction of the arrow A, there are arranged feed advance conveyor belts 4 above bridging means 4'. The bridging means may comprise a piece of sheet metal or the like straddling the distance between the stacking table 1 and a folding table 20. The conveyor belts 4 are tiltable about an axis or pulley 55 to move a printed item 13 against a stop 5. The conveyor belts 4 are arranged in the manner of a cantilever and are driven by a shaft 62 which in turn is driven by a belt 63. The belt 63 is driven through a shaft 64 which in turn is driven by a belt 65 running over a pulley on the shaft 60. Below the rear guide pulley 55 of the conveyor belts 4 there is arranged at least one motor driven feed advance roller 21 which facilitates the transport of the printed items 13 from the conveyor belts 3 onto the bridging member 4' for engagement with the feed advance conveyors 4. The feed advance roller 21 is driven through the shaft 64 and a belt 66, as best seen in FIG. 3.

A light barrier 6 is arranged adjacent to the stop member 5. The light barrier comprises a photocell for the control of a folding member 7, which is thus movable downwardly in the direction of the arrow D, to perform a folding stroke just as soon as a printed item 13 interrupts a light beam. The means for effecting the control such as amplifiers and the like are not shown but well known. The folding member 7 is arranged above a folding table 20 in such a position that it may move into a folding gap 22 in the folding table 20. Guide means 68 assure that the folding member 7 will properly move up and down in a vertical direction. The light barrier 6 controls through an amplifier, not shown, an electromagnet 48, shown in FIG. 3, whereby the energization of the magnet 48 actuates a clutch 49 to provide a force transmitting connection between the drive motor 14 and the crank disk 50 cooperating with a crank arm 52 for driving the folding member 7. The clutch 49 could, for instance, also be constructed as an electro-magnetic clutch which would replace the magnet solenoid 48. A reduction gear means or back gear means 69 on the shaft 70 driving the shaft 72 through a belt 71 is arranged in the drive train between the motor 14, the transmission gear 56 and a belt 56'. The crank disk 50 is secured to a shaft 36 driven by the shaft 72 through gear wheels 73. Thus, the folding member 7 is driven by the motor 14 through the back gear 69, the shaft 70, the belt 71, the clutch 49, the shaft 72, and the gear wheels 73 on the shafts 36, 72.

As best seen in FIG. 2, there is arranged laterally of the frame structure 12, a support station 16 for a stack 75 of individual wrapper strips or bands 8. The wrapper strip stack 75 rests on a set of rollers 23 driven by a motor 24 shown in FIG. 3. All the individual rollers 23 are driven by means of gear wheels 25 as well as by intermediate gears schematically shown in FIG. 3. In the alternative, all the rollers 23 may be driven in the same rotational direction by an endless chain. A vertically adjustable cross bar 26, shown in FIG. 2, again assures that only one wrapper strip 8 may pass through the gap formed between the lower edge of the cross bar 26 and the last roller 23 as viewed in the direction C in which the rollers advance each wrapper strip 8, one at a time.

Conveyor belts 18 advance the individual wrapper strips 8 in a flat disposition into the folding position below the slot 22 in the table 20 and against a stop member 27. The arrangement is such that the feed advance direction A of the printed items 13 extends at right angles to the feed advance direction C of the wrapper strips 8. Moreover, the feed advance direction C extends perpendicularly to the length of the wrapper strips 8. The wrapper strips 8 are preferably made of a strong, substantially tear resistant paper and have a rectangular shape, as viewed from above. The length of these wrapper strips is larger than twice the width of a folded printed item 13 to be wrapped. When a strip 8 rests against the stop 27, one end of the strip will be within the range of an electrical heating device 28 for heating up said one end of the strip 8. It is possible to either use wrapper strips one end surface of which is already provided with a glue, especially a heat responsive glue, or the glue may be applied to said end while the strip is in the present apparatus. In any event, the application of heat or a pressure roller activates the glue and the employed temperature may, for example, be within the range of 100° to 160° C. Glues suitable for this purposes are well known in the art.

Below the folding table 20 there are arraned receiving and clamping means for the folded printed matter and the folded wrapper. In the illustrated preferred embodiment, these receiving and clamping means comprise a rotatable drum 9 forming a plurality of gaps 9' as best seen in FIG. 1. The arrangement is such that the folding members 7 will dip through the gap 22 into the receiving and clamping gaps 9' to fold a printed item simultaneously with the wrapper strip 8. If desired, the printed item 13 may have been pre-folded at least once in the course of its production by means not shown in the present context.

The receiving and clamping drum 9 is supported for intermittent rotation, preferably in 90° steps, by a horizontal axis 15 supported in the frame structure 12. The drum comprises, for example, a total of four endless belts 30, each of which is guided by four guide rollers 31 in such a manner that each of these endless belts 30 forms an L-shape, as best seen in FIG. 1. Each L-leg forms with the next adjacent L-leg a gap 9'. The position of the guide rollers 31 is adjustable, so that the width of the gaps 9' may be varied in accordance with the thichness of the folded printed items and wrapper means forming a unit 42. Thus, four gaps 9' are formed which due to the intermittent rotation of the drum 9 in the direction of the arrow G sequentially align with the gap 22 in the folding table 20, as best seen in FIG. 1. The four gaps 9' form a cross shaped hollow space and the respective vertically positioned upper gap 9' will be aligned with the slot 22 in the table 20, as mentioned.

The conveyor belts 30 are also driven intermittently by the electric motor 14. The belts 30 are periodically driven in synchronism with the folding member 7 when the latter moves downwardly so that the folded printed item will be positively received between the two upper rollers 31 and the respective upper belts 30, thereby to avoid creasing or ripping of the printed matter. The feed advance direction of the belts 30, as shown by the arrow F, is selected so that it is coordinated exactly to the moving speed of the folding member 7. This is accomplished by deriving the drive of the folding member 7 from the same drive shaft 36, which also drives the conveyor bands or belts 30. The shaft 36 drives by means of a sprocket wheel 37' a chain 37 which in turn drives a sprocket wheel 76 and a clutch 78 which may be an electro-magnetically operated clutch. Such a clutch 78, may for example, comprise a metallic disk 33 for each belt 30. The disk 33 is located opposite and in parallel to a further disk, which may be actuated by an electromagnet. When the thus formed clutch 78 is not energized, the drum 9 may be rotated and the belts 30 are not moving. On the other hand, when the clutch 78 is engaged, the drum 9 may not be rotated and the respective set of conveyor belts 30 is advanced to move around the rollers 31. The feed advance of the other belts 30 is accomplished by intermediate gear means, not shown. The arrangement is such, that the upper vertically arranged conveyor belt runs which face each other move in the downward direction to receive therebetween a folded item 42 in the thus formed gap 9'.

As mentioned above, the printed item 13 is folded simultaneously with the wrapper strip 8. In other words, the wrapper strip 8 is bend into a U-shape, so as to envelop the printed item 13 to form a unit 42. The guiding and the feed advance as well as the positioning of the wrapper strip 8 is such that the right hand end extends or protrudes over the edge of the printed item 13, which abuts the stop 5, as best seen in FIG. 1. The folding then takes place along a line below the folding member 7, extending in parallel to the longitudinal extension of the stop member 5. When the folding is completed and the unit 42 is in the vertical gap 9', the protruding end of the wrapper strip extends vertically upwardly as shown in FIG. 1 by a dashed line.

As soon as the folding member 7 has returned to its upper starting position, the excenter 38 releases the drive of the drum 9 by pivoting the levers 39 so that the drum 9 may be rotated through a 90° angle. The actuation of the lever 39 releases the mechanical clutch 40, shown in FIG. 3. The clutch 40 is essentially an excenter which provides for a drive connection between drum 9 and motor 14 through the drive train 56, 56', 69, 41. The mechanical clutch or coupling means 38, 39, 40 may also be replaced by an electro-magnetic clutch.

With the aid of the just described drive train, the drum 9 rotates for about a quarter turn in the direction of the arrow G whereafter the clutch 40 is disengaged and the drum 9 stops. As the drum rotates, the wrapper strip end which protrudes outside the upper edge of the unit 42, is folded over initially for about 90° so that the protruding end envelops the narrow side of the printed matter. This is accomplished because the rotating drum moves the protruding end along the inner surface of the curved fold over member 43, for example, provided in the form of a sheet metal piece or the like. The folding member 43 has about the shape of a quarter circle, the center of which is located in the axis 15 of the drum 9.

During the next feed advance of the belts 30, that is when the folding member 7 again moves downwardly, the movement of the belts 30 discharges the unit 42 in the direction of the arrow F into a receiving station 10. This motion assures that the now vertically extending end of the wrapper strip is folded back into an overlapping relationship with the opposite end of the wrapper. Thus, the overlapping ends are secured to each other, for example by gluing, as mentioned above.

The receiving and discharge station 10 comprises, for example, two endless conveyor belts 44, which advance the unit 42 in the direction of the arrow B. The endless conveyor belts 44 run over respective guide and tensioning rollers. In addition, there are provided pressure rollers 45, which facilitate the proper securing of the wrapper ends to each other. The glue previously heated in the device 28 is sufficiently cooled down due to the contact with the other end of the wrapper strip so that a proper gluing is accomplished. The drive of the receiving end discharge station 10 is derived from the shaft 70, which is connected through belts, for example V-belts 80 and 81, to further shafts 83 and 84, as best seen in FIG. 3.

Following the receiving and discharge station 10 there may be arranged a conveyor means 57, which transports the units 42 to further handling stations, not shown. The entire apparatus and frame structure 12 may be supported on wheels 58' so that it could easily be moved into any suitable operational position.

Although the invention has been described with reference to specific example embodiments, it is to be understood, that it is intended to cover all modifications and equivalents within the scope of the appended claims.

What is claimed is:

1. An apparatus for applying a wrapper to sheets of paper, comprising a frame structure, folding means supported in said frame structure for folding simultaneously the wrapper and the sheets of paper so that an end of the wrapper protrudes from an edge of the sheets of paper, a rotatable drum also supported in said frame structure for receiving and clamping the folded sheets of paper and the wrapper as they are being folded, and means held in said frame structure for folding over and pressing said protruding wrapper end around said edge of the sheets of paper whereby the wrapper ends overlap each other, said rotatable drum comprising a plurality of endless conveyor belts and guide pulleys supporting said conveyor belts relative to each other on said drum so that each endless conveyor belt cooperates with two adjacent endless conveyor belts, said guide pulleys being positioned in said rotatable drum so as to guide each endless conveyor belt to substantially form an L-shape, whereby a gap is formed between adjacent L-shapes facing each other for receiving and holding folded sheets of paper and the respective folded wrapper in said gaps between two conveyor belts forming a pair, wherein said folding means form a folding station whereas said folding over and pressing means form a discharge station, said rotatable drum being operatively arranged to transport folded sheets of paper and the respective wrapper from said folding station to said discharge station, said means for bending over said protruding wrapper end being operatively arranged between said folding station and said discharge station whereby the rotating drum moves said protruding wrapper end along said bending over means to fold the protruding wrapper end against the edge of the sheets of paper, and means operatively connected to said drum for intermittently advancing said drum from said folding station to said discharge station.

2. The apparatus according to claim 1, wherein said folding station and said discharge station are spaced from each other by about 90°, and wherein said bending over means comprise a curved piece of sheet metal forming approximately a quarter circle and arranged between said folding station and said discharge station for cooperation with said drum.

3. The apparatus according to claim 1, wherein said plurality of conveyor belts and pulleys comprise four conveyor belts displaced by 90° relative to each other around the drum whereby each belt is a member of two pairs of belts, said folding means including a movable folding member driven in synchronism with said drum for dipping into each of said gaps, whereby the sheets of paper and the wrapper are folded into the gap registering with the folding member, said gaps corresponding in number to the number of belt pairs, said drum advancing means stepping said drum through a predetermined angle with each step for sequentially aligning each gap with said folding member.

4. The apparatus according to claim 1, wherein said discharge station is arranged adjacent to said rotatable drum to receive the folded sheets of paper and wrapper from the conveyor belts as the latter move the folded sheets of paper and wrapper out of the respective gap, said pressing means pressing the folded sheets of paper and the now overlapping wrapper ends together.

5. The apparatus according to claim 1, further comprising heating means supported in said frame structure in such a position that one end of said wrapper, which end is provided with a heat activatable glue, may be heated, said folding means further comprising a folding table, said heating means being arranged adjacent to and somewhat below said folding table.

6. The apparatus according to claim 5, wherein said folding means comprise a movable folding member arranged above said folding table, and a slot in said folding table below said folding member to receive the folding member on its downward stroke, first transport means for advancing said sheets of paper to the top of said folding table above said slot, and further transport means arranged at right angles to said first mentioned transport means and slightly below said first mentioned transport means for moving said wrapper to a folding position below said table and slot.

7. A folding drum for applying a wrapper to sheets of paper comprising a rotational axis, rotatable supporting means secured to said rotational axis, a plurality of endless conveyor belts, a number of pulleys for each of said endless conveyor belts secured to said supporting means in such positions that each endless conveyor belt cooperates with two adjacent endless conveyor belts in the formation of one folding gap between each pair of two adjacent endless conveyor belts whereby the number of gaps corresponds to the number of endless conveyor belts.

8. The folding drum according to claim 7, further comprising drive means for driving said endless conveyor belts so that two belt runs which face each other to form said gap move in the same direction.

9. The folding drum according to claim 7, wherein each of four endless conveyor belts is arranged in an L-formation, and wherein said four endless conveyor belts form four pairs of conveyor belts and four respective gaps.

* * * * *